United States Patent [19]

Lang

[11] Patent Number: 4,624,111

[45] Date of Patent: Nov. 25, 1986

[54] PRESEPARATOR FOR A PIPE CARRYING A TWO-PHASE MIXTURE

[75] Inventor: Helmut V. Lang, Plainsboro, N.J.

[73] Assignee: BBC Brown, Boveri & Company, Limited, Baden, Switzerland

[21] Appl. No.: 720,732

[22] Filed: Apr. 8, 1985

[30] Foreign Application Priority Data

Apr. 16, 1984 [CH] Switzerland ..... 1899/84

[51] Int. Cl.[4] ..... F01B 31/30

[52] U.S. Cl. ..... 60/694; 60/657; 55/397

[58] Field of Search ..... 60/646, 657, 694; 55/392, 396, 397

[56] References Cited

U.S. PATENT DOCUMENTS

| | | | |
|---|---|---|---|
| 3,603,062 | 9/1971 | Robbins et al. | 55/396 X |
| 3,884,660 | 5/1975 | Perry, Jr. et al. | 55/396 |
| 4,355,515 | 10/1982 | Cohen et al. | 60/657 |
| 4,527,396 | 7/1985 | Silvestri, Jr. | 60/657 X |

FOREIGN PATENT DOCUMENTS

| | | |
|---|---|---|
| 96916 | 12/1983 | European Pat. Off. . |
| 1912805 | 12/1971 | Fed. Rep. of Germany . |
| 961953 | 5/1950 | France . |
| 2357818 | 2/1978 | France . |
| 393552 | 6/1933 | United Kingdom . |

OTHER PUBLICATIONS

Brown Boveri Mitteilungen, pp. 66–75, Jan. 1976.

*Primary Examiner*—Stephen F. Husar

*Attorney, Agent, or Firm*—Burns, Doane, Swecker & Mathis

[57] ABSTRACT

A preseparator for use in a saturated-steam turbine installation comprising an outer pipe, a first internal pipe positioned within the outer pipe and which includes a constriction, an annular gap of isokinetic size between the beginning of the internal pipe and the outer pipe, a second internal pipe positioned between the first internal pipe and the outer pipe so as to define chambers, and ports communicated with the chambers.

2 Claims, 4 Drawing Figures

PRESEPARATOR FOR A PIPE CARRYING A TWO-PHASE MIXTURE

FIELD OF THE INVENTION

The invention relates generally to devices for separating water from working steam and more particularly to a preseparator in a steam turbine installation.

BACKGROUND OF THE INVENTION

In saturated-steam turbine installations, the wet steam issuing from the high-pressure action of the turbine is dried and then slightly superheated before it enters the low-pressure turbine. These steps are effected in water separators/superheaters by mats of wire netting or baffle plate walls, as described in Brown Boveri Mitteilungen, January 1976, volume 63, line 66, et seq.

The disadvantage of this arrangement is that the down-flow line between the high-pressure turbine and the water separator elements in the steam flow is exposed to a relatively high water content.

This condition inevitably promotes erosion and/or corrosion and creates undesirable pressure drops.

Moreover, when water surges and local high concentrations of moisture form, the moisture can no longer be separated out by the separator to a significant degree.

Furthermore, the efficiency of separation of water by mats of wire netting and baffle plate walls depends upon the flow velocity of the steam, upon the droplet size and upon the absolute level of the wetness treatment.

It is known to expose the aforementioned separator elements as uniformly as possible to steam either by flow resistances arranged upstream or downstream of the separator elements, according to European Pat. No. 0,005,225 B1, or by special design of the flow paths, according to Swiss Pat. No. 483,864.

Although the exposure to wetness can be partially evened out by these measures, water surges and water streaks remain, and the absolute magnitude of the mean wetness can therefore not be changed. In this connection, it is known that, at about 10% wetness, the pressure drop in the connecting lines between the high-pressure turbine and the water separator is about 3 times greater than in the case of dry steam.

It is also known from European Pat. No. 0,096,916 A1 to provide in a high-speed water separator, upstream of the deflection blades, a water preseparator which essentially consists of a continuous slit in the wall of the pipe elbow, which slit is overlapped by a cover plate which projects into the flow channel. Although this achieves a separation of the water flowing in the vicinity of the pipe wall, "peeling" of the wall wetness concentration can be only very small if, as intended, only water in laminar flow is to be dealt with.

It is the disadvantages of the known solutions mentioned above for which the invention provides a remedy.

OBJECTS AND SUMMARY OF THE INVENTION

An object of the present invention is to provide a preseparator which achieves good degrees of water separation and which, at the same time, separates the layer of steam transporting the water to be precipitated from the working steam, so that irregular pipe wall water flows, such as surge flows, plug flows, wave flows and the like, can be handled effectively. Furthermore, it is an object of the invention to provide a preseparator which can be retrofitted at low cost even into existing turbine installations.

These and other objects are achieved by the present invention which provides a preseparator for separating entrained water from a flow of working steam being conveyed through a delivery pipe. The preseparator includes a first internal pipe positioned within an outer pipe so as to form an interspace therebetween and a second internal pipe positioned between the other two pipes so as to divide the interspace into chambers. The first internal pipe forms a constricted passage through the preseparator and its upstream end is spaced from the outer pipe so as to form an annular gap of isokinetic size.

In a delivery pipe which is the down-flow line carrying steam between a high-pressure turbine and the preseparator, a major proportion of the entrained water flows in the vicinity of the wall of the delivery pipe. This pre-existing phase separation is exploited at the annular gap, whose dimensioning separates water-laden steam along the walls from the remainder of the working steam. The pipes further cooperate to effect separation of the water from the water-laden steam, with water being evacuated from one of the two interspace chambers through a first port and steam being evacuated through a second port.

The result is that the pressure drops on the steam side between the high-pressure turbine and a superheater are minimized by a reduction in wetness at a preliminary stage.

The reduction in the wetness content reduces erosion and corrosion in the connecting lines and reduces the heat consumption of the turbo-set. Due to the good separation of water in the preseparator, the potential for water surges and water streaks in the downstream water separator elements is reduced when the preseparator according to the invention is installed. Preferably, the preseparator is installed downstream of the high-pressure section of turbine and upstream of a second water separator preceding a resuperheater. The second water heater may be of any desired design. This arrangement reduces the breakthrough of water and increases the overall efficiency of the water separation process, as viewed across all the separator elements installed.

Also, the present invention not only can be readily incorporated into the construction plans of future turbine installations, but also can be easily retrofitted into existing installations, if it is found in the latter after start-up that the water separation is unsatisfactory.

BRIEF DESCRIPTION OF THE DRAWING

The preferred embodiments of the present invention are represented in the drawing wherein.

Any elements not necessary for an understanding of the invention have been omitted. The direction of flow of the media is indicated by arrows. The same elements are provided with the same reference symbols in the figures.

DETAILED DESCRIPTION OF THE PREFERRED EMBODIMENTS

Figure 1:
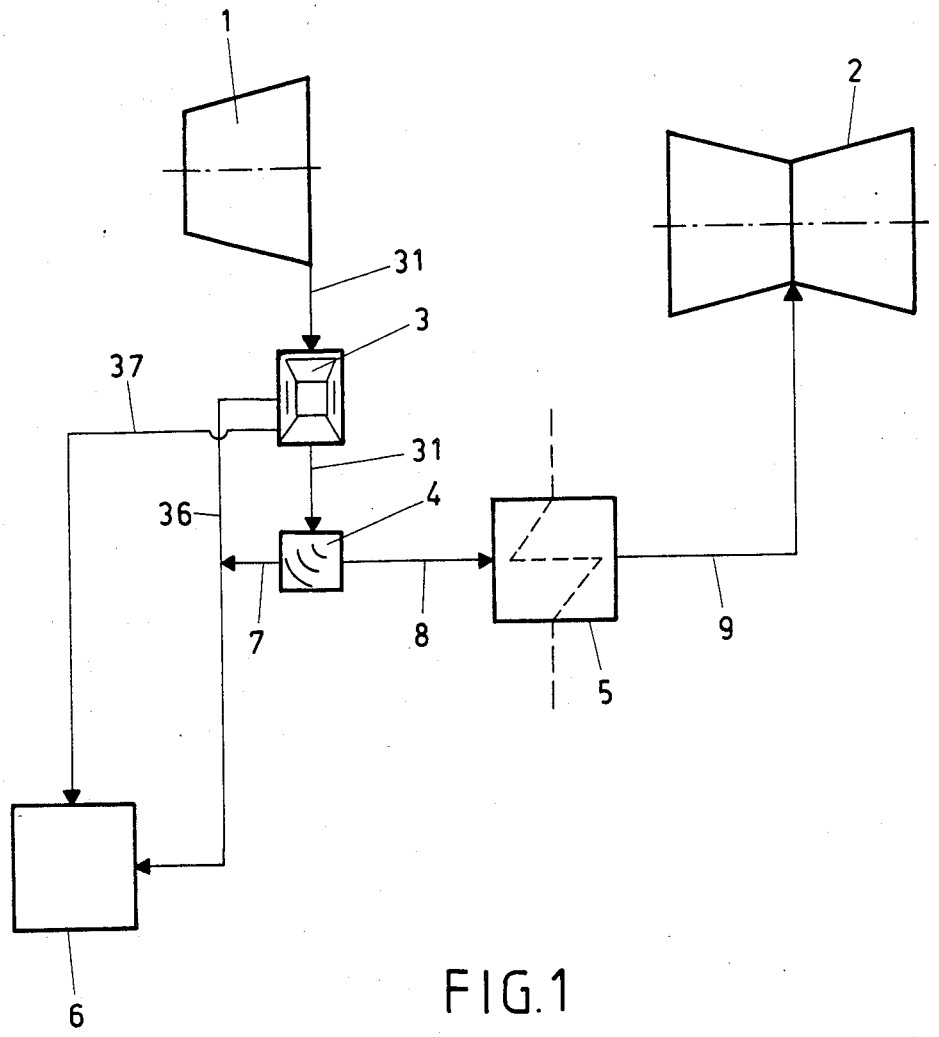
FIG. 1 is a diagram of a saturated-steam turbine arrangement with installed water separators including one constructed in accordance with the present invention.

Referring to FIG. 1, a preseparator 3 according to the present invention is integrated into a saturated-steam turbine installation having a requirement for water separation. The steam issuing from the high-pressure turbine 1 first flows through the preseparator 3 placed immediately downstream of the turbine 1. The steam then flows through a second water separator, for example a high-speed separator 4, via a continuation of the pipe 31 and finally passes via the line 8 into the resuperheater 5. Of course, the final water separation, apart from the preseparator 3 mentioned, can alternatively be achieved with a number of water separators of any desired design. Their particular member and design depends upon the desired degree of water separation, which preferably is as high as practical in order to improve the turbine efficiency and to reduce blade erosion in the low-pressure turbine 2. In addition, a turbine installation with the preseparator 3 can operate without, for example, an expensive water separator superheater which are known to cause a high pressure drop.

After the steam 9 has passed through the resuperheater 5, it is dry to an optimum degree and is admitted to the low-pressure turbine 2. The steam 9 is regarded here as being treated to an optimum degree, if it expands in the low-pressure turbine 2 to a quite "conventional" degree of final wetnesses. A water/transport steam/-working steam phase separation takes place in the preseparator 3. In this case, the precipitated water 37 and the separated transport steam 36 are passed to a pressure sink 6. Of course, the transport steam 36 separated in the preseparator 3 can also be passed individually to another pressure sink, for example a preheater. The water 7 precipitated in the high-speed separator 4 flows out together with the water 37.

As a result of the arrangement described, it is not necessary to trim the high-speed separator 4 by means of internal fittings to the required degrees of water separation of more than 95%. Rather, high separation rates and efficiencies can be obtained by arranging several high-speed separators 4 of simple design in series, with the addition of an upstream preseparator 3. With this arrangement, a residual wetness of 1–2% upstream of the low-pressure turbine is achieved. Because of the resultant reductions in pressure drops and residual wetness, 7.5 MWe more electrical energy can be generated in a 1000 MWe installation.

The mutual arrangement of the water separators does not necessarily have to be parallel.

Figure 2:
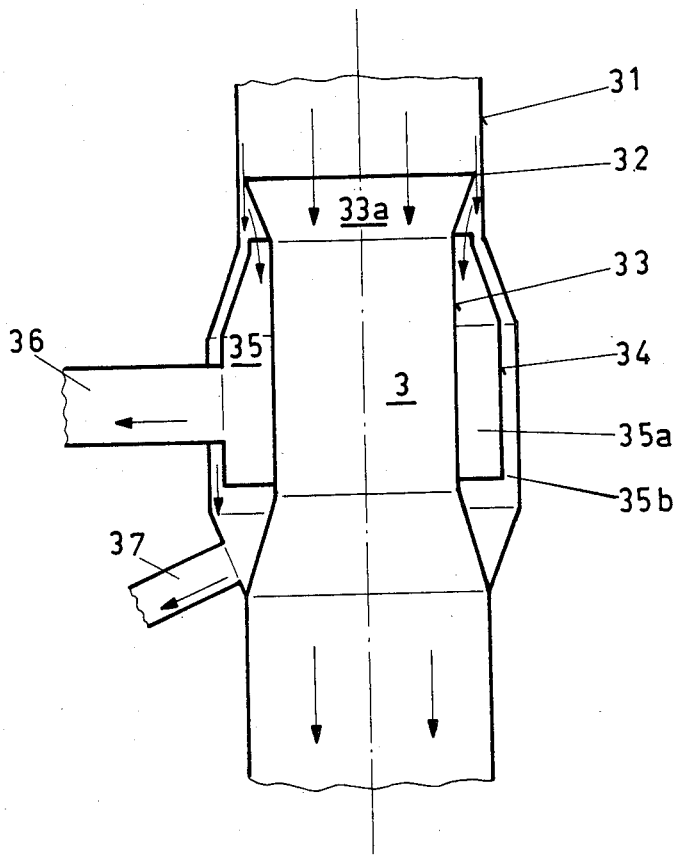
FIG. 2 is a detailed cross-sectional view of a preseparator constructed in accordance with a preferred embodiment of the present invention.

Referring to FIG. 2, the pipe 31 carrying steam has a concentric internal pipe which preferably has the shape of a Laval nozzle 33*a*. An annular gap 32 exists between the pipe 31 and the inlet port of the internal pipe 33. Further downstream of the annual gap 32, the pipe 31 bulges outwardly forming an interspace 35 in which a second concentric intermediate pipe 34 is provided. The pipe 34 has, on the pipe side, a contour similar to that of the pipe 31. Thus, a chamber 35*b* of constant dimensions in the direction of flow is formed between the pipe 31 and the intermediate pipe 34. Where demanded by the flow conditions, the chamber 35*b* is widened in the direction of flow, for example at a rate of 5%. Downstream of the port 36 and upstream of the other port 37, the internal pipe 34 has a bottom closure, whereby the other chamber 35*a* is formed from which the port 36 in the form of a line starts. Downstream of the bottom closure of the internal tube 34 and upstream of the steam-tight joint between the pipe 31 and the internal pipe 33, the chamber 35*b* likewise has a port 37 in the form of a line.

In the pipe 31 which, according to FIG. 1, is the down-flow line carrying steam between the high-pressure turbine 1 and the preseparator 3, the major part of the water flows in the vicinity of the pipe wall. This pre-existing phase separation in the flow is exploited in the annular gap 32, the dimensioning of which is selected such that the flow through the annular gap 32 remains isokinetic. Accordingly, the annular gap 32 is large enough so that the velocity of the boundary layer in the flow does not vary when flowing through the annular gap 32.

Since the internal pipe 33 has the form of a Laval nozzle 33*a*, the velocity of the water/transport steam mixture separated off decreases downstream of the annular gap 32. This has the consequence that, for example, a wave flow is calmed into laminar flow, so that an internal phase separation of this mixture can easily be effected in the interspace 35 by the inlet port, forming a gap, of the internal pipe 34. While the transport steam is extracted through the port 36, the water flows out through the port 37.

Figure 3:
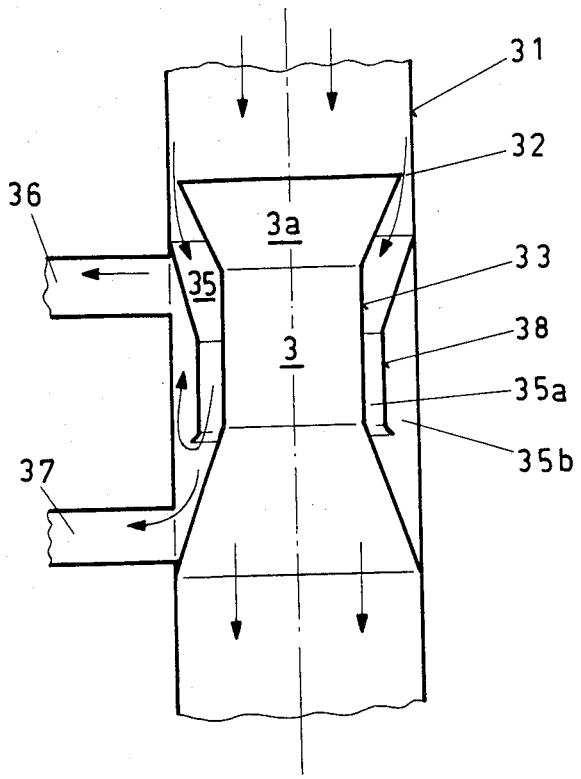
FIG. 3 is a detailed cross-sectional view of a preseparator constructed in accordance with another preferred embodiment of the present invention.

Referring to FIG. 3 in a second, alternate embodiment of the preseparator 3, the pipe 31 is not curved outwardly as in the embodiment of FIG. 2. The interspace 35 is therefore naturally smaller, and the internal phase separation between water and transport steam downstream of the annular gap 32 does not take place as the result of "peeling" by means of fitting a further gap-forming internal pipe. The internal pipe 38 provided here is open at the bottom and only divides the interspace 35 into two mutually communicating chambers 35*a*, 35*b*. The internal pipe 38 is joined steam-tight to the pipe 31 upstream of the port 36. The water/transport steam mixture being expanded flows downstream of the annular gap 32 through the chamber 35*a*, the phase separation of the mixture having proceeded to such an extent, after it has passed through the chamber, that the transport steam can then flow out in the counter-current direction through the chamber 35*b* to the port 36. By contrast, the water flows out through the port 37.

Figure 4:
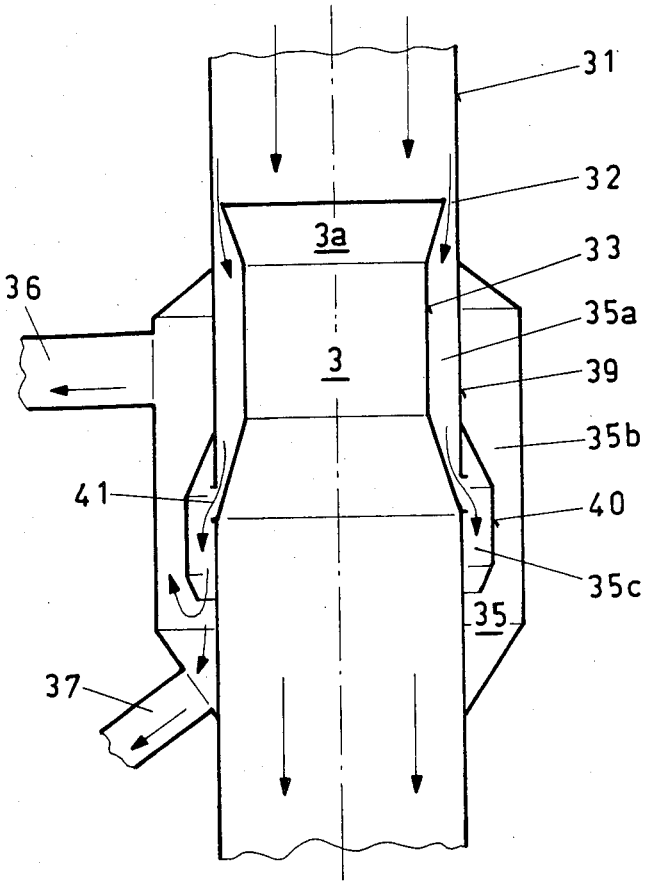
FIG. 4 is a detailed cross-sectional view of a further preseparator constructed in accordance with a third preferred embodiment of the present invention.

Referring to FIG. 4, a third preferred embodiment, of the preseparator 3 has three chambers 35*a*, 35*b*, 35*c*. From where the preseparator 3 begins to bulge outwardly, an internal pipe 39 forms the continuation of the pipe 31. This internal pipe 39 extends to the outlet of the internal pipe 33 and is provided there with ports 41 arranged in a peripheral direction. The internal pipe 33 forms a Laval nozzle. The ports 41 are in turn enclosed by a further internal pipe 40 which has the function of an impingement wall.

When the separated, water/transport steam mixture flows through the chamber 35*a* and out of the ports 41, it impinges upon the inner wall of the internal pipe 40, with the effect that the phase separation then proceeds largely mechanically. While the water can flow off via the port 37, the transport steam flows out via the port 36.

The installation of the preseparator according to the invention in existing installations at a later stage can be accomplished in a simple manner by cutting out a piece of the pipe 31 and inserting in its place the desired variant of preseparator.

The preseparators are preferably installed vertically.

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. A preseparator for separating water from steam comprising:

an outer pipe and a first internal pipe positioned within the outer pipe, the first internal pipe having a constriction, an upstream end of the first internal pipe being spaced from the outer pipe so as to form an annular gap adapted to admit flow with an absence of a substantial variation of velocity, adjacent portions of the outer pipe and the first internal pipe forming an inter-space therebetween;

at least one additional internal pipe positioned downstream of the annular gap and between the first internal pipe and the outer pipe so as to divide the inter-space into chambers; and first and second ports provided in said outer pipe and communicating with at least one of said chambers.

2. The preseparator according to claim 1, wherein the first internal pipe has the form of a Laval nozzle.

* * * * *